US008840087B2

(12) United States Patent
Guyard

(10) Patent No.: US 8,840,087 B2
(45) Date of Patent: Sep. 23, 2014

(54) TELESCOPIC RACK-AND-PINION LIFTING DEVICE

(75) Inventor: Francois-Xavier Guyard, Chambon sur Cisse (FR)

(73) Assignee: Talbot Decoupage Emboutissage, Mer (FR)

( * ) Notice: Subject to any disclaimer, the term of this patent is extended or adjusted under 35 U.S.C. 154(b) by 79 days.

(21) Appl. No.: 13/356,866

(22) Filed: Jan. 24, 2012

(65) Prior Publication Data

US 2012/0181490 A1 Jul. 19, 2012

(30) Foreign Application Priority Data

Jul. 20, 2010 (EP) ..... 10007497

(51) Int. Cl.

| | |
|---|---|
| ***B66F 3/16*** | (2006.01) |
| ***B66D 1/14*** | (2006.01) |
| ***B66F 3/00*** | (2006.01) |
| *B66F 3/02* | (2006.01) |

(52) U.S. Cl.
CPC .... *B66F 3/00* (2013.01); *B66F 3/02* (2013.01)
USPC ..... 254/97; 254/345; 254/346; 254/350

(58) Field of Classification Search
CPC ..... B66F 3/02
USPC ..... 254/97, 350, 345, 346
See application file for complete search history.

(56) References Cited

U.S. PATENT DOCUMENTS

| | | | | | |
|---|---|---|---|---|---|
| 303,504 | A | * | 8/1884 | Garcin | 254/97 |
| 1,482,924 | A | * | 2/1924 | Hescock | 192/15 |
| 2,546,202 | A | * | 3/1951 | Trouin | 242/381.6 |
| 2,947,537 | A | * | 8/1960 | Littell et al. | 226/156 |
| 3,047,114 | A | * | 7/1962 | Stevens, Jr. | 192/16 |
| 3,116,919 | A | * | 1/1964 | Alth | 269/21 |
| 3,434,317 | A | * | 3/1969 | Jacobi | 70/388 |
| 3,458,127 | A | * | 7/1969 | Hermann | 235/95 R |
| 3,921,958 | A | * | 11/1975 | Brockelsby et al. | 254/420 |
| 3,934,852 | A | * | 1/1976 | Weber et al. | 254/420 |
| 3,994,476 | A | * | 11/1976 | van Gennep | 254/272 |
| 4,004,780 | A | * | 1/1977 | Kuzarov | 254/345 |
| 4,045,000 | A | * | 8/1977 | Mai | 254/45 |
| 4,120,484 | A | * | 10/1978 | Zimmer | 254/6 C |
| 4,424,824 | A | * | 1/1984 | Becher | 135/20.3 |
| 4,456,227 | A | * | 6/1984 | Notenboom | 254/350 |
| 4,471,946 | A | * | 9/1984 | Maeda | 254/350 |
| 4,702,458 | A | * | 10/1987 | Kendrick | 254/97 |
| 5,012,689 | A | * | 5/1991 | Smith | 74/89.17 |
| 5,020,777 | A | * | 6/1991 | Yocum | 254/95 |
| 5,305,989 | A | * | 4/1994 | Nishi et al. | 254/352 |
| 5,421,555 | A | * | 6/1995 | Sims | 254/420 |
| 5,451,136 | A | * | 9/1995 | Easton | 414/795.8 |
| 5,622,085 | A | * | 4/1997 | Kostrzewa | 74/498 |
| 5,941,261 | A | * | 8/1999 | Kouvaras et al. | 135/27 |
| 5,975,806 | A | * | 11/1999 | Delamatyr | 405/198 |

(Continued)

*Primary Examiner* — Lee D Wilson
*Assistant Examiner* — Alvin Grant
(74) *Attorney, Agent, or Firm* — Bachman & LaPointe, P.C.

(57) ABSTRACT

A lifting device with a telescopic pole that has a lower module and an upper module which is mounted in vertical sliding relation with respect to the lower module and which is movable along the pole by a crank handle through a rack-and-pinion drive mechanism. A non-return locking device is automatically implemented by friction coupling mechanism with a drive pinion of the drive mechanism driven by rotating the crank handle for more than one complete turn.

11 Claims, 7 Drawing Sheets

(56) References Cited

U.S. PATENT DOCUMENTS

| | | | | |
|---|---|---|---|---|
| 5,979,875 | A * | 11/1999 | Yocum | 254/95 |
| 6,101,702 | A * | 8/2000 | Claycomb et al. | 29/426.4 |
| 6,244,810 | B1 * | 6/2001 | Reyes | 414/11 |
| 7,241,289 | B2 * | 7/2007 | Braun | 606/1 |
| 7,331,567 | B2 * | 2/2008 | Li | 254/95 |
| 7,461,599 | B2 * | 12/2008 | Hachikawa | 104/242 |
| 7,793,919 | B2 * | 9/2010 | Guyard | 254/346 |
| 7,886,624 | B1 * | 2/2011 | Mayeaux | 73/866.5 |
| 7,975,812 | B2 * | 7/2011 | Gonska et al. | 188/205 R |
| 8,191,864 | B2 * | 6/2012 | Ruan | 254/95 |
| 2009/0121204 | A1 * | 5/2009 | Guyard | 254/218 |
| 2011/0062273 | A1 * | 3/2011 | Guyard | 242/395 |
| 2012/0181494 | A1 * | 7/2012 | Guyard | 254/385 |

* cited by examiner

Fig. 2
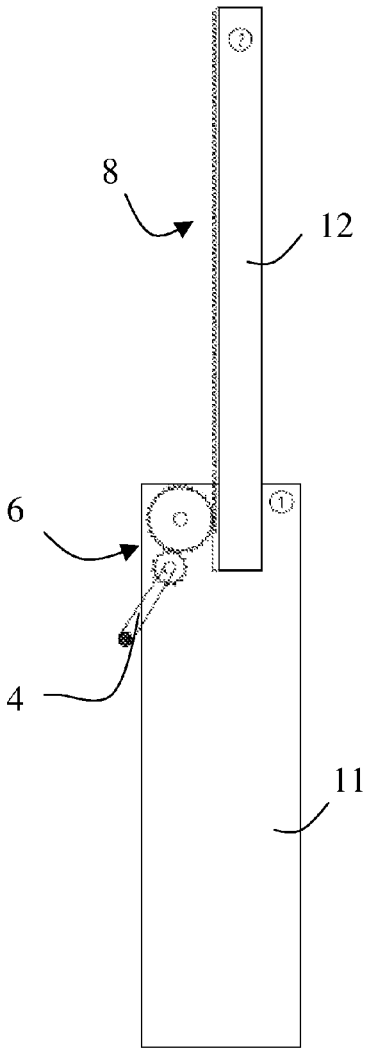
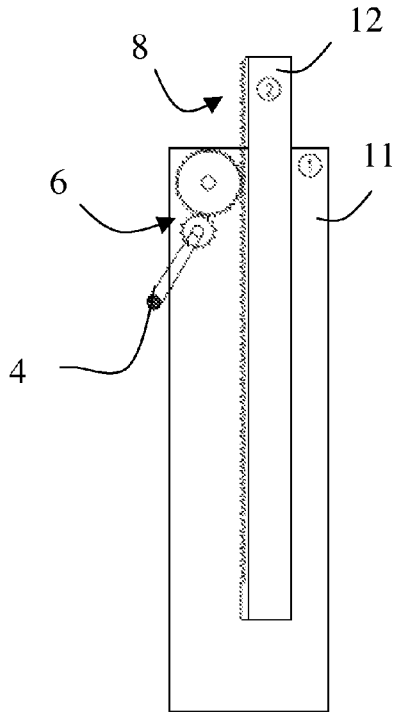
Fig. 2a
Fig. 2b

Fig. 6
Fig. 6a
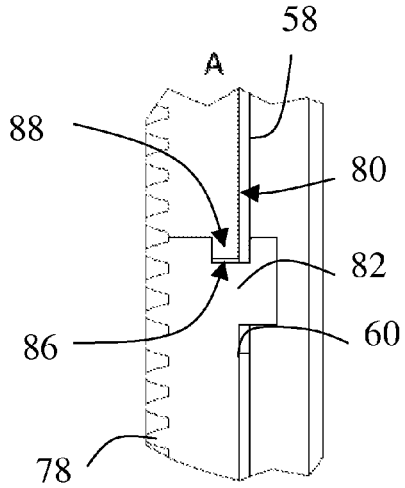
Fig. 6b
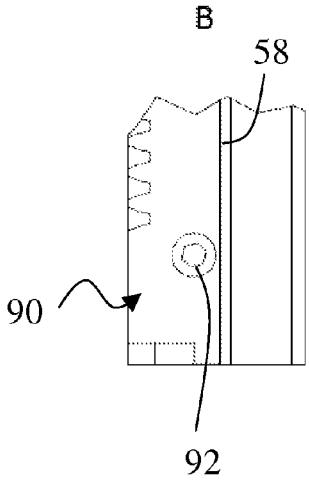
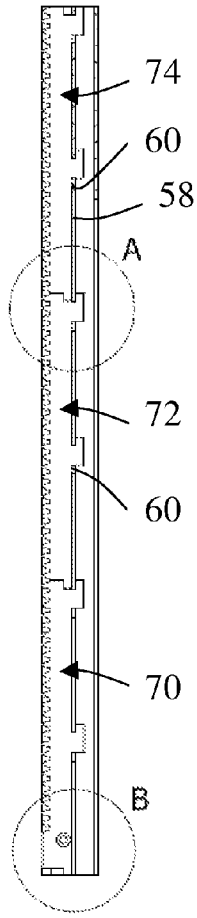

TELESCOPIC RACK-AND-PINION LIFTING DEVICE

BACKGROUND

This invention concerns the design and construction of a rack-and-pinion telescopic lifting apparatus. The device can vertically displace a load over several meters. It consists of a telescopic pole whose base can be equipped as needed with a fixed or mobile stand and, at the top, with any system that will enable the load to be attached or handled.

Telescopic lifting devices already exist which comprise modules that slide vertically over each other and in which the movement of an upper module with respect to a lower module is obtained by one or several cables connecting up the modules. Extension of the system and vertical displacement of the load attached to the upper module are obtained by means of a tensile force exerted on the crank handle of a winch fixed to the outside of the lower module and the base of the device and to which the end of one of the cables is connected.

A winch-driven cable has the disadvantage of requiring a complex set of pulleys which generates a large amount of friction, requiring both additional effort on the part of the operator to lift the load and a much longer load lifting time. The cable is also exposed to a number of risks such as crushing, jamming and corrosion, which rapidly reduces its life time and requires costly regular maintenance operations. At the extreme, the cable can break and cause accidents.

SUMMARY OF THE INVENTION

The invention is aimed at avoiding these pitfalls by means of a lifting device with a telescopic pole and a mechanical rack-and-pinion direct drive system to control the displacement of an upper module with respect to a lower module, the transfer of movement between a rotating crank handle mounted on the lower element of the reference module, or fixed base module, and a rack solid with the upper module being provided, quite conventionally, by a rotating pinion gear train cooperating with the rack teeth.

No longer using a cable wound around a winch eliminates a major disadvantage of the winch system arising from variations in the force exerted by the operator to lift a given load over a given distance. The length of cable which must be pulled by the operator each time depends on the developed length of the turn, which varies according to the number of successive turns on the winch reel around which the cable is wound.

In conjunction with a mechanical rack-and-pinion direct drive system, the present invention is designed to protect the lift mechanism with an non-return locking system which is automatically triggered during extension of the telescopic pole by friction coupling with a pinion in the gear train ensuring transfer of the rotation for more than one complete turn of the crank handle mounted on the lower element so that it is accessible from the outside, to the rack solid with the upper element.

The lift device according to the invention thus entails a drive mechanism with a high level of efficiency and particularly reliable operation.

Various secondary features of the invention concern the construction of the non-return drive-locking device, which can usefully include a friction brake based on those described for a winch in the published patent documents EP2058266 and EP2284116. The matter of both documents may be referred to if necessary to facilitate understanding of the following description of the appended figures.

However, the lifting apparatus, produced using the preferred construction methods for its industrial implementation, includes other features relating to the composition of the rack equipping the upper module of the telescopic stage.

The rack is thus usefully made up of several parts, herein included one on top of the other longitudinally or stacked one against the other transversely, said parts being assembled in mounted position in the upper module of the telescopic device in a self-locking relation to each other and together with respect to the said module.

The main features of the said rack are as follows:

- The rack is mounted in a groove formed vertically by an extruded section essentially forming the upper element of the telescopic stage, the rack having catches designed to fit into slots at the bottom of the said groove.
- The rack consists of successive sections connected one to the other along the entire length of the corresponding module.
- In each of these sections, where applicable, the rack is made of suitably cut steel sheet shapes which are placed one next to the other so that they match up exactly to form the teeth of the rack.

In the preferred implementation methods according to the invention, the rack thus consists of superimposed layers of sheet steel shapes, with the final thickness of the multi-layer rack being equivalent to the width of the groove formed by the extruded section of the module (the upper module of the telescopic stage) corresponding to a self-locking mounting.

The invention thus has the advantage of resulting in a lightweight construction, in relation to both the rack and to the extruded steel tube in which it is mounted. The multi-layer construction enables the rack to withstand buckling despite the fact that it must sustain high stress due in particular to the friction coupling of the rack-and-pinion drive system by means of a locking system to counteract a sudden reverse movement during lifting of a load. The design according to the invention also has the advantage of facilitating simple, economical construction.

The device according to the invention can have further features which can be implemented separately or in combination depending on each particular application, as explained below:

- Each rack section has a notch on the upper part and an indexing lug on the lower part, the width of the notch being equal to the sum of the width of the said lug and the thickness of the intermediate side of the groove formed in the upper module to take the rack;
- The device includes a fixation system passing through the said groove in the upper module (also called the second module in the following detailed description of the figures) and also passing through the lower section of the rack to ensure that the rack assembly is locked into the groove;
- The lower section of the rack has an end portion without teeth to prevent further displacement of the upper module in the direction of its withdrawal from the lower module during extension of the telescopic mounting;
- The friction brake locking system consists of a ratchet wheel engaged with a safety pawl mounted on an extruded section comprising the lower module of the telescopic stage (or first module, also subsequently called the fixed base module), the said ratchet wheel being made solid with a drive pinion driven by the crank handle in the direction moving away from the upper module with respect to the lower module, and free to rotate in the direction of withdrawal of the upper module into the lower module.

BRIEF DESCRIPTION OF THE DRAWINGS

The invention will now be completely described in relation to its preferred features and their advantages, referring to the figures in the appended drawings illustrating the said features, in which:

FIG. 2 illustrates, by means of a simplified drawing, the operation of a device according to the invention with a second module supporting a rack and shown in extended position (FIG. 2*a*) and in stowed position (FIG. 2*b*);

FIG. 6 is a cross-section of the second module and corresponding rack consisting of three sections, with enlargement (FIG. 6*a*) of the area in which two sections are joined and with enlargement (FIG. 6*b*) of the lower area of the rack;

DETAILED DESCRIPTION OF THE PREFERRED EMBODIMENT(S)

The lifting device according to the invention consists of a telescopic pole 2 designed to extend under the action of a crank handle 4 which is added to the pole and is associated with a gear reduction device 6 to drive a rack 8 solid with a pole module, the said module being displaced telescopically with respect to the base of the pole.

Turning the crank handle drives the rack causing displacement of the module associated with the rack, either upwards or downwards depending on whether the telescopic system is to go up or down, thus eliminating the use of a winch and cable and making the system both reliable and safe under all circumstances, the drive system being coupled with a friction brake system passively locking the load into position, both when the mobile upper module moves towards the lower module and when said mobile upper module moves away from the lower module, without the operator having to apply force to prevent the load from descending.

Figure 1:
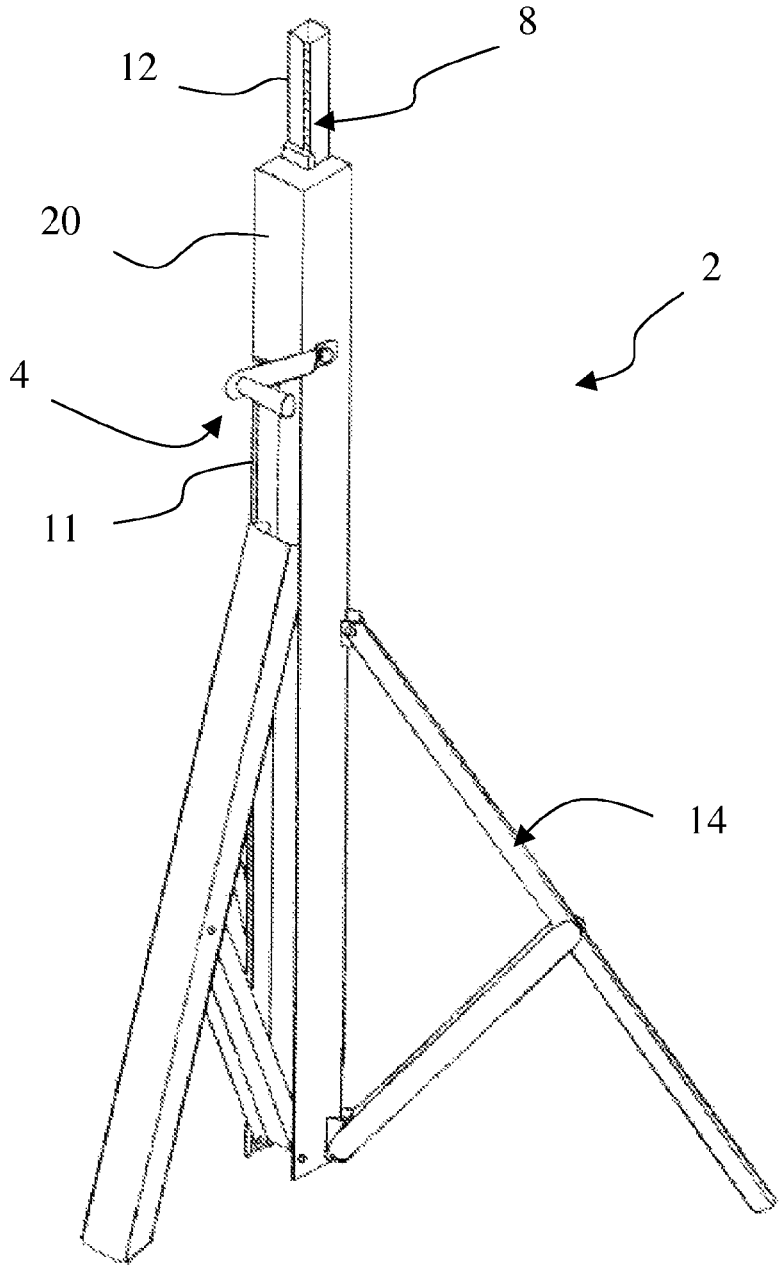
FIG. 1 shows a telescopic lifting device according to the invention with a base module of the pole to which a stand system has been added together with a crank handle to drive the second module of the device, the second module being shown to be partially extended outside the first.
Figure 3:
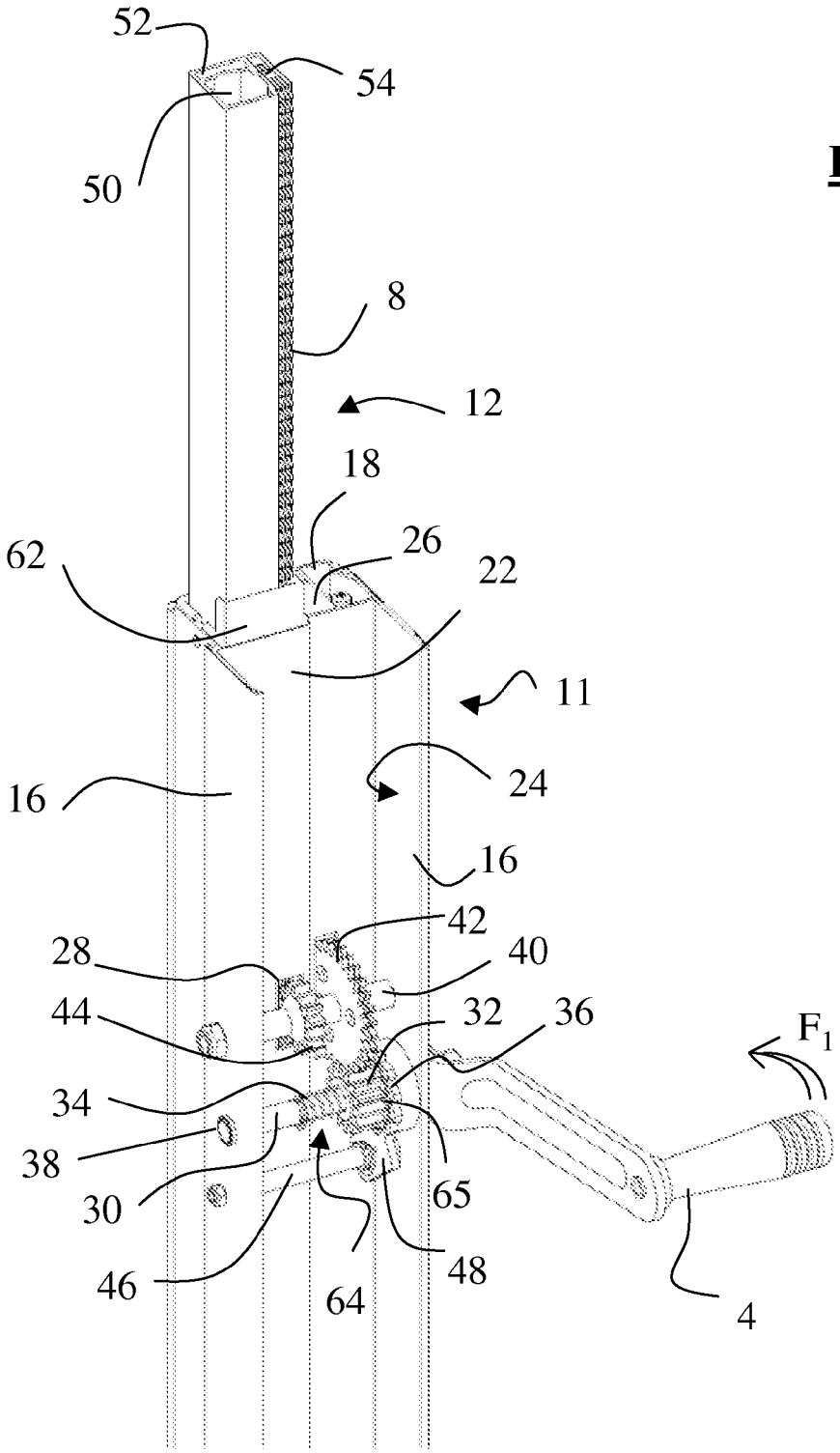
FIG. 3 illustrates the upper part of the first module of the device without its protective cover, in order to show the drive device associated with the crank handle and designed to cause vertical displacement of the rack and second module of the device.

In the construction method described, the telescopic pole consists of two extruded steel modules 11 and 12, seen in FIGS. 1 to 3, with the second module sliding inside the first base module. For this purpose, the base module 11 supports the drive and gear reduction mechanism associated with the crank handle as well as the brake system, while the sliding module 12 supports the rack designed to cooperate with a pinion in the drive system.

The base module comprises an extruded tube usefully made of aluminium so that the weight of the pole assembly is such that it can be easily displaced on a work site. A stand 14 can be provided to stabilise the pole in which case it is fixed to the base module.

The tube consists of two side walls 16 opposite each other and a rear wall 18 which connects up the two rear ends of the side walls transversely. It can be observed that the front of the tube is open so that the cross-section of the tube is approximately U-shaped. A cover 20 can be added to close and secure the open part of the extruded tube.

A central web 22 stretches across the inside of the tube parallel to the rear wall between the two side walls. The central web thus defines two areas, one to take the drive mechanism 24 which will be located on the open side of the tube, and the other to guide the sliding module 26.

The guidance area has stiffening walls and provides a free guidance passage with a cross-section equivalent to that of the second module.

A notch 28 is made in the central web to ensure communication between the drive mechanism area and the guidance passage of the sliding module.

The drive and gear reduction mechanism 6 consists of a set of gears mounted on two shafts in the area formed between the side walls of the tube.

A first shaft forms a primary shaft 30 mainly supporting a drive pinion 32, a spring 34 and a ratchet wheel 36. The primary shaft is mounted in rotation on bearings 38 embedded in the side walls. One end of the first shaft is solid with the crank handle.

A second shaft forms a secondary shaft 40, mounted parallel to the primary shaft. The secondary shaft mainly supports a driven pinion 42, which engages with a drive pinion and a rack drive pinion 44 which is positioned so that one part of the pinion passes through the notch in the central web.

Sufficient clearance must be left so that the drive and driven pinions can turn freely in the base module. Clearance notches can be provided for this purpose as seen in FIG. 3.

A third shaft 46 is mounted between the side walls of the tube and supports a safety pawl 48, which is positioned so that it engages with the ratchet wheel on the primary shaft. The operation of the said mechanical safety device will be described below.

The sliding module 12 comprises an extruded tube usefully made of aluminium so that the weight of the pole assembly is such that is can be easily displaced on a work site.

The extruded tube forming the sliding module comprises a central compartment 50, a rear compartment 52 and a groove to take the rack 54. When constructing a two-module pole, the central and rear compartments will necessarily remain empty and can be used to attach the load to the end of the sliding module. In a non-illustrated construction in which the number of sliding modules comprising the telescopic pole is greater than two, the above compartments are designed to take a sliding module and a strap for the extension of the said additional module.

The groove in the upper module takes the rack which is automatically locked into the groove. In the construction method described here, which is not restrictive, the groove is formed on one side of the sliding module between a side wall 56 and a wall delimiting the central compartment and the rear compartment. The groove extends across the entire width of the sliding module and an intermediate wall 58 is positioned vertically in the groove. Slots 60 are formed in the intermediate wall to enable the projecting portions of the rack to be lodged in the groove.

As can be seen in FIG. 3, the upper part of the base module is equipped with a protective cover 62 which also includes a module guidance function. The cover is pressed up against the inside surfaces of the area that takes the second module. It is equipped with self-locking clips so that when the second module is position, the cover cannot move. On the second module, the lower end, which is designed to remain inside the volume of the first module throughout operation, is equipped with a non-illustrated component covering the outside walls and guiding the second module inside the first module. Thus, the base module is equipped with a device to guide the second module in order to facilitate its displacement and reduce friction between each module.

As described previously, a gear reduction system is connected to the crank handle which is either fixed or removable, so as to be directly engaged with the rack solid with the extruded section and bring about its displacement.

The gear reduction system consists of pinions and rotating spindles. The number, size and position of the latter can vary and are defined according to the load, speed and force required.

In the construction example illustrated, turning the crank handle to lift the load results in rotation of the drive pinion 32 mounted on the primary shaft and directly engaged with the driven pinion 42 mounted on the secondary shaft, so that the said turning of the crank handle in the direction of rotation shown on FIG. 3 by the arrow F1, causes rotation of the secondary shaft and the rack drive pinion 44 which is solid with the rack, thereby raising the rack and the sliding module to which the rack is fixed. It can be observed that, in the direction of rotation indicated by arrow F1, the shape of the ratchet wheel engaged with the safety pawl is such that it does not prevent rotation of the primary shaft.

Turning of the crank handle by an operator thus transfers the force required to displace the load. Rotation of the pinions in the gear reduction system could easily be initiated not by human force on a crank handle but by a driving torque.

Here, the gear reduction and brake systems are directly incorporated inside the base module. It is possible however to position the said systems so that they project beyond the base module and are housed in a box added to the base module.

Whatever the case, the system is designed to allow the rotation of a rack drive pinion which passes through the central web of the extruded section and cooperates with the teeth of the sliding module rack in order to displace the said module.

The drive system is friction-coupled to a self-locking drive locking system 64 such that the load is continually held in position whether the crank handle is being turned by the operator or not.

Here we will describe a particularly effective drive locking system developed by the applicant. It is mainly provided by the ratchet wheel cooperating with the safety pawl.

The ratchet wheel is used here as a typical example of a cam disk. It is mounted so that it can freely rotate around the primary shaft, between two blocker rings 65 (illustrated in FIG. 4 in particular) solid with the primary shaft. Under the effect of a lateral force, along the axis of the primary shaft and in the direction of the crank handle, the blocker rings are pressed radially against the cam disk and the three components are coupled together by friction. The cam disk is then rotationally attached to the primary shaft and the locking system is coupled by the said friction to the drive system.

The lateral force required to make the ratchet wheel solid with the blocker rings is obtained either by displacement of the drive pinion along the primary shaft in the direction of the ratchet wheel, or by the action of a spring mounted in compression around the primary shaft and pushing the drive pinion up against the ratchet wheel.

For this purpose, the drive pinion has an internal thread 66 and is screwed onto a threaded part 68 of the primary shaft. The direction of the threads is such that when the primary shaft is caused to rotate in clockwise direction to extend the telescopic mounting by raising the upper component (arrow F1 on FIG. 3), the pinion tends to move axially towards the crank handle and therefore towards the ratchet wheel.

For the displacement of the sliding module away from the base module, causing the mobile module on the contrary to move downwards, the primary shaft is caused to rotate in an anticlockwise direction. The effect of the spring, together with that of the drive pinion which is pushed towards the blocker rings, makes the ratchet wheel solid with the blocker rings and rotationally makes the ratchet ring solid with the primary shaft. The shape of the teeth on the ratchet wheel however enables the shaft to rotate by disengaging from the pawl each time.

On the other hand, if circumstances are such that the sliding module can suddenly drop, for example, because the operator stops turning the crank handle, the ratchet wheel which is fully engaged with the safety pawl and is rotationally made solid with the primary shaft will prevent the sudden drop from taking place. This provides a passive safety component which guarantees the user that the load will not suddenly fall.

For the displacement of the sliding module towards the base module, the primary shaft is caused to rotate in a clockwise direction. The direction of the threads on the primary shaft and inside the drive pinion causes the pinion to move towards the spring. The ratchet wheel is rotationally disconnected from the primary shaft because the blocker rings are not compressed against the wheel, so that the latter does not counteract rotation of the shaft and withdrawal of the sliding module. The operator must provide sufficient torque on the crank handle for the drive pinion to counteract the spring return force and be displaced.

It can be observed that the presence of the return spring enables displacement of the sliding module to be controlled even in the absence of inertia or loading.

The load is thus held in position regardless of the circumstances. The force exerted on the crank handle enables the load to go up or down freely. Here no additional manual safety is needed, because the invention proposes an automatic friction brake coupled to the rack drive of the sliding module, by cooperation of the brake system and the pinions that drive the rack on the same drive shaft.

Figure 4:
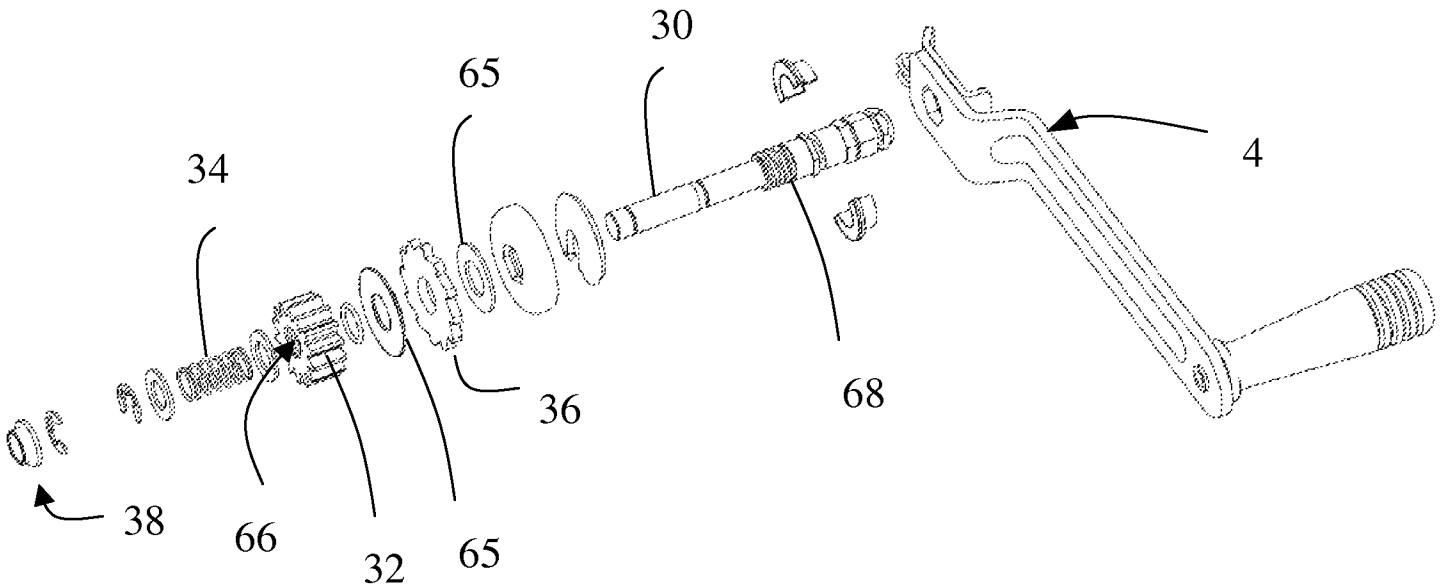
FIG. 4 is an exploded view of the crank handle and primary shaft of the drive system.
Figure 5:
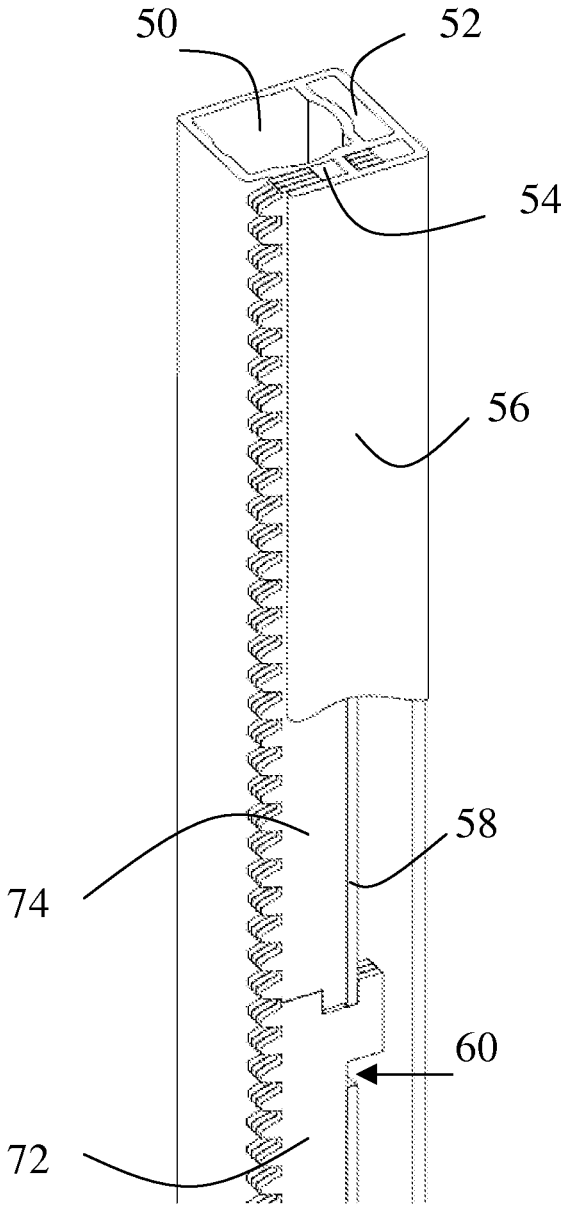
FIG. 5 is a partial cross-section of the second module shown by itself, with two of the sections forming the rack locked into a groove in the said module.
Figure 7:
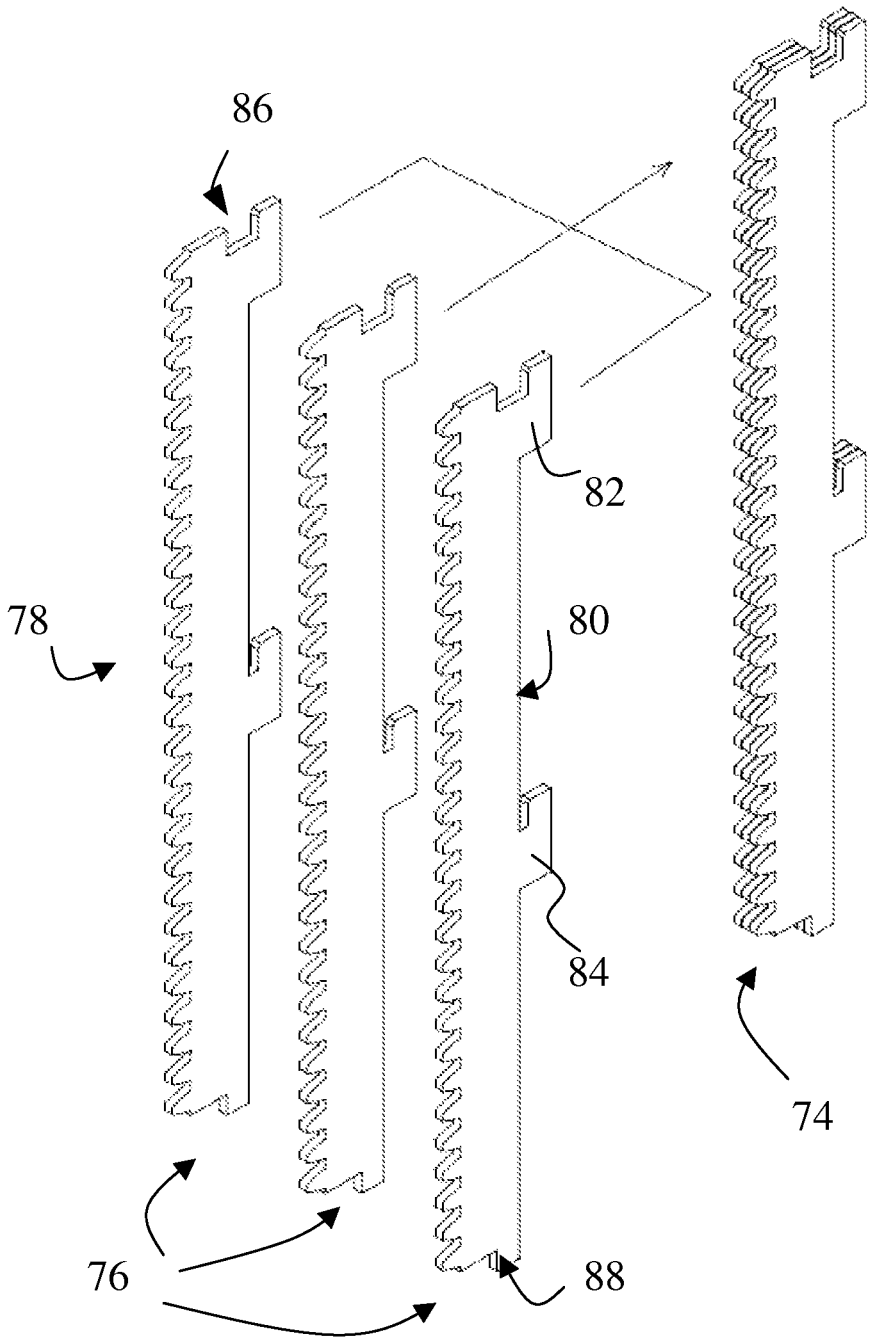
FIG. 7 shows assembly of three steel sheet shapes forming a rack section according to the invention.

Certain details of the self-locking brake system which have not been specifically mentioned up until now can be clearly seen in the exploded view in FIG. 4. In particular, two half-rings can be seen which, by self-locking, form the support surfaces of the automatic friction brake between the radial face at the end of the pinion and the disk supporting the ratchet wheel, without a rigid frame being required to provide the said surfaces. The corresponding self-locking mounting is similar to that described for a self-locking friction brake on a cable wound around a winch reel in the European patent application 09 010459 mentioned at the beginning of this description.

We will now describe in more detail the rack and the way it is assembled with the extruded section of the sliding module (upper or second module).

The rack, in the particular implementation method chosen to best illustrate the invention, consists of a vertical and transverse stack of standard parts.

The rack shown in the different figures is made up of three successive sections stacked vertically one on top of the other, with a lower section 70 which is fixed to the lower part of the sliding module and is therefore designed to remain inside the base module, followed by an intermediate section 72 and an upper section 74. Here, we have shown a rack with three sections, but it is easy to understand that dividing the rack into sections means that it can be adapted to a telescopic pole of any size simply by adding or subtracting sections.

In each section, the rack has three blades 76 bracketed together to form an assembly. Just as the number of sections in a rack can vary, so can the number of blades bracketed together to form a section. The number of blades can thus differ according to the final rack thickness required.

Each blade in the same rack section has an identical shape. For the upper and intermediate sections, the blades have a mainly rectangular cross-section with a toothed side 78, the teeth being shaped to cooperate with the drive pinion in the drive system. The side opposite the toothed side has a straight edge 80 and catches in the form of lugs, with a first upper catch 82 and a second intermediate catch 84 half-way up the blade. The upper side of the blade has a notch 86, which, together with the upper catch, forms a U-shaped notch, while the lower side of the blade has indexing lugs 88.

For the lower section of the rack, the blades are identical in shape to that of the blade described above, except that the lower part is not toothed. This lower section thus has an unnotched part 90, which prevents the sliding module from completely leaving the volume of the base module during extension of the sliding module, in the limit position seen in FIG. 2*a*. A hole is also bored through the thickness of the blades forming the said lower section.

The blades are cut out of sheet steel. Thus, standard parts of complex shape and identical profile can be obtained for both the lugs and notches and the teeth. In the finished assembly, after being mounted in the extruded section of the module that takes the rack, the blades in each section of the rack are locked together, in respective juxtaposed positions in which the lugs and notches on the blades and the teeth on the toothed side are automatically matched up.

The rack is mounted in its groove in the following way. The upper section of the rack is made to slide into the groove. The upper and intermediate catches in this section are inserted into the slots and the section of rack concerned is pushed down into the groove so that the right edge of the section is up against the intermediate side of the groove. In this position, only the teeth of the rack section project beyond the groove. The upper section is then moved upwards until the U-shaped notch is up against the intermediate side of the groove, as shown in FIG. 6 in particular. The upper section is held in this vertical position while the intermediate section is made to slide into the groove, matching up the catches in the rack and the slots in the extruded module in the same way as above. The intermediate section is then moved upwards until the U-shaped notch is up against the intermediate wall. In this position, the indexing lug located on the lower part of the upper section of the rack is locked in position between the intermediate side of the groove and the U-shaped notch of the intermediate section. The intermediate section is held in this vertical position, with the upper section self-locked to the intermediate section and sides of the groove. The lower section is then made to slide into position, proceeding in the same manner as above so that the notch on the lower section matches up with the indexing lug on the intermediate section. The vertical stack of rack sections is then locked in place using a screw 92 through the lower section of the rack and the walls of the extruded section so that all the parts are held captive by the groove.

Due to the self-locking mounting of each rack section with the one directly next to it and the additional use of a screw to hold the lower section in position, the entire rack is prevented from moving in opposite translation directions. It is also prevented from moving in the third direction, perpendicular to the translation direction, in particular by the fact that the blades forming the rack in each section are held in position between the two sides of the groove whose width is approximately equal to the total thickness of the juxtaposed blades.

As described above, the lower section of the rack is designed to mechanically stop the rack from going any further. This prevents the pole from being extended beyond the height defined. And it is particularly useful that this is achieved without requiring an additional mechanical part to do so.

The description above clearly explains how the invention is able to achieve its objectives. The rack here is usefully constructed by means of a stack of standard shapes which has the advantage of simplifying manufacture and reducing the weight of a rack which it would be complicated to produce and for which considerable effort would be required to lift a load. The multi-layer construction consisting of juxtaposed blades also means that it has good strength properties and stress resistance despite its light weight.

The invention claimed is:

1. A lifting device with a telescopic pole that comprises a base module and a sliding module which is mounted in vertical sliding relation with respect to said base module and which is movable along said telescopic pole by means of a crank handle through a rack-and-pinion drive mechanism, wherein a non-return locking device is automatically implemented by friction coupling means with a drive pinion of said rack-and-pinion drive mechanism driven by rotating said crank handle for more than one complete turn, and wherein a rack of said rack- and pinion drive mechanism is self locked into a groove formed vertically in an extruded tube forming said sliding module, said rack having catches of suitable shape to fit into slots in a bottom of said groove.

2. A lifting device with a telescopic pole that comprises a base module and a sliding module which is mounted in vertical sliding relation with respect to said base module and which is movable along said telescopic pole by means of a crank handle through a rack-and-pinion drive mechanism, wherein a non-return locking device is automatically implemented by friction coupling means with a drive pinion of said rack-and-pinion drive mechanism driven by rotating said crank handle for more than one complete turn, and wherein a rack of said rack-and-pinion drive mechanism consists of successive sections that are mounted in a self-locking relation to each other.

3. A lifting device with a telescopic pole that comprises a base module and a sliding module which is mounted in vertical sliding relation with respect to said base module and which is movable along said telescopic pole by means of a crank handle through a rack-and-pinion drive mechanism, wherein a non-return locking device is automatically implemented by friction coupling means with a drive pinion of said rack-and-pinion drive mechanism driven by rotating said crank handle for more than one complete turn, and wherein a rack of said rack-and-pinion drive mechanism consists of juxtaposed layers of blades cut from sheet steel.

4. A lifting device with a telescopic pole that comprises a base module and a sliding module which is mounted in vertical sliding relation with respect to said base module and which is movable along said telescopic pole by means of a crank handle through a rack-and-pinion drive mechanism, wherein a non-return locking device is automatically implemented by friction coupling with a drive pinion of said rack-and-pinion drive mechanism, wherein a rack of said rack-and-pinion-drive mechanism is made of successive sections that are mounted in a self-locking relation to each other, each said successive section being made of juxtaposed layers of blades cut from sheet steel, and wherein each said successive section has a notch on an upper part and an indexing lug on a lower part, for self-locking mounting of a rack assembly in a groove formed in said sliding module in which said juxtaposed layers of blades are held captive.

5. The device according to claim 4, wherein a fixation system passes through said groove of the sliding module and a lower section of the rack to ensure that the rack assembly is locked in position in said groove.

6. The device according to claim 4, wherein a lower section of the rack has an end portion without teeth.

7. The device according to claim 4, wherein said sliding module is mobile and wherein said locking device is automatically implemented by friction coupling both when the mobile sliding module moves towards the base module and when said mobile sliding module moves away from the base module.

8. A lifting device with a telescopic pole that comprises a base module and a sliding module which is mounted in vertical sliding relation with respect to said base module and which is movable along said telescopic pole by means of a crank handle through a rack-and-pinion drive mechanism, wherein a non-return locking device is automatically implemented by friction coupling with a drive pinion of said rack-and-pinion drive mechanism driven by rotating said crank handle for more than one complete turn, wherein said locking device has a cam disk mounted so that said disk can rotate freely around a bearing shaft of the drive pinion and means for applying elastic stress to press a radial surface of the drive pinion against the cam disk and thus achieve said friction coupling, wherein a brake system ensures said friction coupling with a ratchet wheel engaged with a safety pawl mounted on said base module, wherein said ratchet wheel is made solid with a primary shaft of said rack-and-pinion drive mechanism supporting said drive pinion when said sliding module moves away from the base module, and wherein said ratchet wheel is allowed to rotate freely when said sliding module moves towards said base module.

9. The device according to claim 8, wherein said brake system comprises two half-rings shaped to provide a support surface between said radial surface of the drive pinion and said cam disk without a rigid frame being required to provide said support surface.

10. A lifting device with a telescopic pole that comprises a base module and a sliding module which is mounted in vertical sliding relation with respect to said base module and which is movable along said telescopic pole by means of a crank handle through a rack-and-pinion drive mechanism, wherein a non-return locking device is automatically implemented by friction coupling with a drive pinion of said rack-and-pinion drive mechanism, wherein a rack of said rack-and-pinion drive mechanism is made of successive sections that are mounted in a self-locking relation to each other, each said successive section being made of juxtaposed layers of blades cut from sheet steel, wherein each said successive section has a notch on an upper part and an indexing lug on a lower part for self-locking mounting of a rack assembly in a groove formed in said sliding module in which said juxtaposed layers of blades is held captive, and wherein said locking system has a cam disk mounted so that said cam disk can rotate freely around a bearing shaft of the drive pinion and means for applying elastic stress to press a radial surface of the drive pinion against the cam disk and thus achieve said friction coupling.

11. The device according to claim 10, wherein said sliding module is mobile and wherein said locking system is automatically implemented by friction coupling both when the mobile sliding module moves toward the base module and when said mobile sliding module moves away from the base module.

* * * * *